United States Patent [19]

Muehlbauer et al.

[11] 3,949,830

[45] Apr. 13, 1976

[54] FAN SILENCER

[75] Inventors: James H. Muehlbauer, Evansville; Larry A. Wandtke, Newburgh, both of Ind.

[73] Assignee: George Koch Sons, Inc., Evansville, Ind.

[22] Filed: June 20, 1975

[21] Appl. No.: 588,672

[52] U.S. Cl. ..... 181/50; 181/35 R; 181/42; 181/61

[51] Int. Cl.[2] ..... F01N 1/10; F01N 1/24

[58] Field of Search ..... 181/50, 56, 69, 42, 35 R, 181/61, 62

[56] References Cited

UNITED STATES PATENTS

| | | | |
|---|---|---|---|
| 2,428,040 | 9/1947 | Sauerbier | 181/62 |
| 2,940,537 | 6/1960 | Smith et al. | 181/50 |
| 2,990,906 | 7/1961 | Audette | 181/50 |
| 3,688,865 | 9/1972 | Smith | 181/56 |
| 3,776,365 | 12/1973 | Richards | 181/50 |

FOREIGN PATENTS OR APPLICATIONS

| | | | |
|---|---|---|---|
| 974,427 | 11/1964 | United Kingdom | 181/50 |

*Primary Examiner*—Stephen J. Tomsky

*Attorney, Agent, or Firm*—Jenkins, Hanley & Coffey

[57] ABSTRACT

A fan silencer having an external shell of annular cross section and a cylindrical central core mounted on a rigid frame. The external shell and the inner core each contain noise absorbing insulation, and have easily removable wall sections to allow fast and easy replacement of said insulation and cleaning of said wall sections.

11 Claims, 6 Drawing Figures

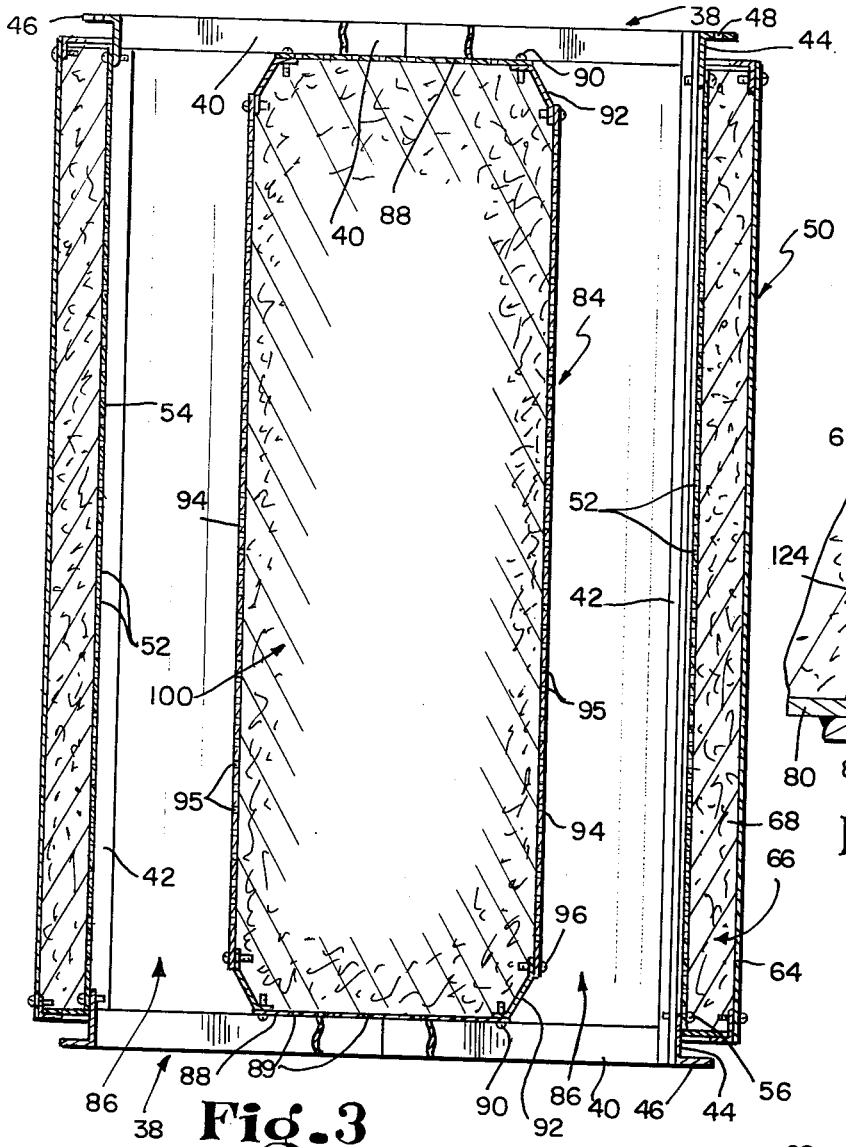
Fig. 3
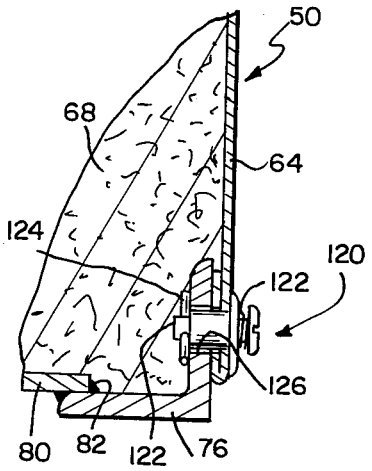
Fig. 6
Fig. 4
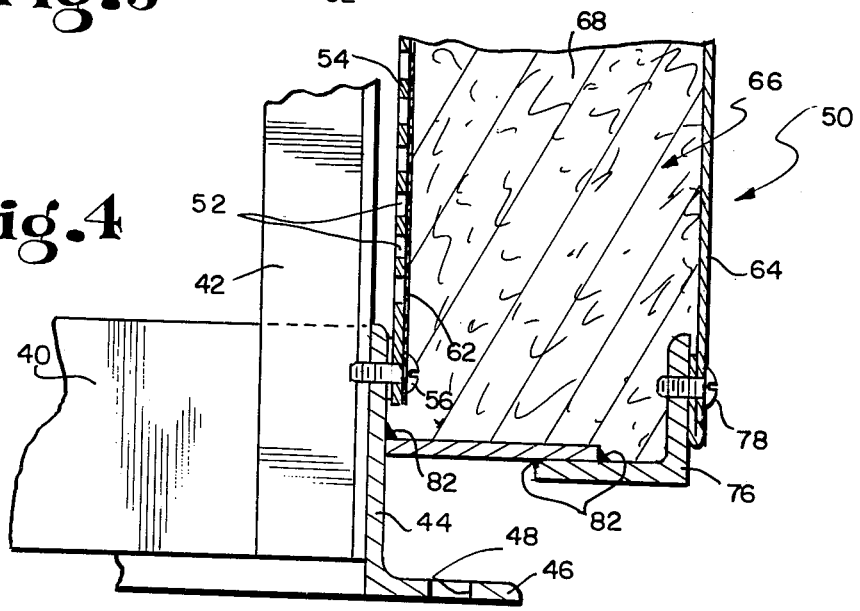

FAN SILENCER

BACKGROUND OF THE INVENTION

This invention relates to silencing equipment for fans, and more specifically, to an improved fan silencer having removable covers to permit fast and easy replacement of sound absorbing or barrier materials (herein referred to as insulating materials) contained therein.

In industrial applications, exhaust fans for moving large volumes of air are widely used for drawing harmful or annoying fumes, vapors, mists, etc. away from a working area. Unfortunately, these high volume exhaust fans often operate at relatively high noise levels which can have harmful effects upon persons in the working area. Governmental agencies have increasingly recognized the possible harmful effects from high levels of industrial noise, and are becoming increasingly involved in the regulation of such noise. As a result, a wide variety of fan silencing equipment has been proposed to absorb exhaust fan noise, and thereby reduce noise in the working area to a safe level.

While a wide variety of silencers for exhaust fans are available throughout the prior art, such silencers typically comprise a silencer housing mounted along ductwork between the fan and the working area. The housing contains an insulating, or noise absorbing, material and is designed to allow air flow therethrough while providing adequate noise control. However, in many industrial applications, the air drawn through the silencer contains large quantities of harmful vapors or moisture. This is especially true, for example, when the exhaust fan is used to draw air from a spray painting work station. The drawn air tends to carry paint solvent and moisture vapors and particles through the fan silencer to saturate the silencer insulating material and coat the silencer housing with paint. This saturation significantly reduces the noise deadening efficiency of the fan silencer, and thereby results over a period of time in increased noise levels at the working area. Unfortunately, it has heretofore not been possible to replace the silencer insulating material or to clean the silencer housing without removing the entire silencer from the ductwork. Such removal of the silencer is a time consuming procedure, and results in the work station being unusable until the silencer is replaced.

It is therefore desirable to provide an improved fan silencer which has removable housing walls to allow fast and easy replacement of insulating material therein, and fast and easy cleaning of the housing walls. Further, it is desirable to provide such a silencer wherein said replacement of insulating material and cleaning of housing walls can be accomplished without removing the silencer from the ductwork.

SUMMARY OF THE INVENTION

In accordance with the invention, a fan silencer is provided having a longitudinally extending frame for mounting the silencer into ductwork between an exhaust fan and a work station. The frame has an external shell of annular cross section comprising an outer wall and a perforated inner wall spaced radially inwardly therefrom, with noise absorbing insulating material being supported between said inner and outer walls. The frame also has a cylindrical central core connected thereto and spaced radially inwardly from said external shell to provide an air flow passage of annular cross section through the silencer. The core comprises an end plate mounted on the frame at each end thereof, and a perforated core wall removably connected to said end plates with insulating material contained therein.

The outer and inner walls of the external shell of the silencer, and the core wall of the silencer central core, are each formed from a plurality of arcuate wall sections. Said inner and outer wall sections and said core wall sections are respectively interconnected by releasable connecting means accessible from the outwardly presented surfaces thereof. Thus, the outer wall sections of the external shell are removable from the silencer frame for cleaning and for replacement of the external shell insulating material. Then, the inner wall sections of said shell are removable for cleaning and to expose the silencer central core. The core wall sections are then also removable from the frame for cleaning and for replacement of the insulating material therein.

BRIEF DESCRIPTION OF THE DRAWINGS

The accompanying drawings illustrate the invention. In such drawings:

FIG. 3 is a horizontal section of the silencer taken on the line 3—3 of FIG. 2;

FIG. 4 is an enlarged view of a portion of FIG. 3 showing the interconnection between the external shell of the silencer and the silencer frame;

FIG. 6 is an enlarged view, similar to FIG. 4, showing alternate connecting means for use with a fan silencer of this invention.

DETAILED DESCRIPTION OF THE PREFERRED EMBODIMENT

Figure 1:
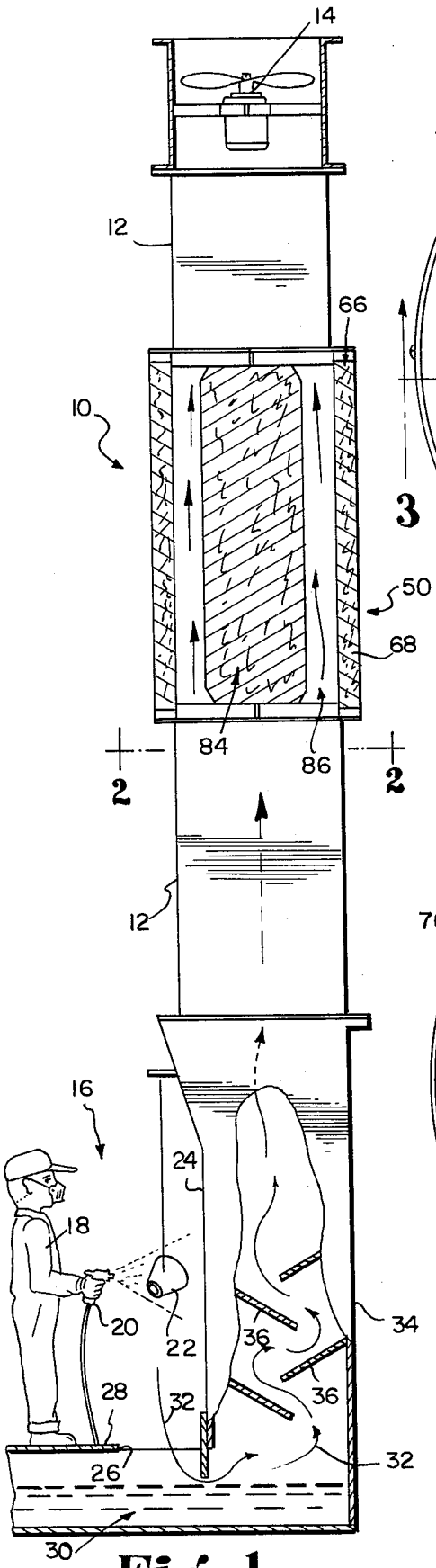
FIG. 1 is an elevation view, in partial section, of a fan silencer of this invention installed in a typical industrial air exhaust system.

A fan silencer 10 of this invention is illustrated in FIG. 1 installed in a typical industrial air exhaust system. As shown, the silencer 10 is mounted along a straight portion of ductwork 12 between an exhaust fan 14 and an industrial work station 16, such as a painting booth. The silencer is provided to absorb noise generated by the fan 14, and thereby reduce the noise volume at the work station to a safe level.

At the painting booth 16, a worker 18 utilizes paint spraying apparatus 20 for spray painting any desired object 22. Typically, wash water continuously rinses paint from a back wall 24 of the booth, and this water drains through an opening 26 in the booth floor 28 into a channel 30 for recycling. At the same time, the exhaust fan 14 draws air from the painting booth 16 through the floor opening 26, as shown by the arrows 32. In this manner, paint fumes, paint particles, and water mist or vapors are drawn away from the worker 18 and are pulled upwardly through a circuitous path provided by a damping assembly 34 having a series of dampers 36. These dampers are provided in an attempt to trap paint and water particles in the air stream to prevent said particles from passing through the ductwork 12 to the silencer 10. However, such dampers are at best only partially effective, and some moisture and paint in both vapor and particle form is pulled into the silencer by the fan 14.

Figure 2:
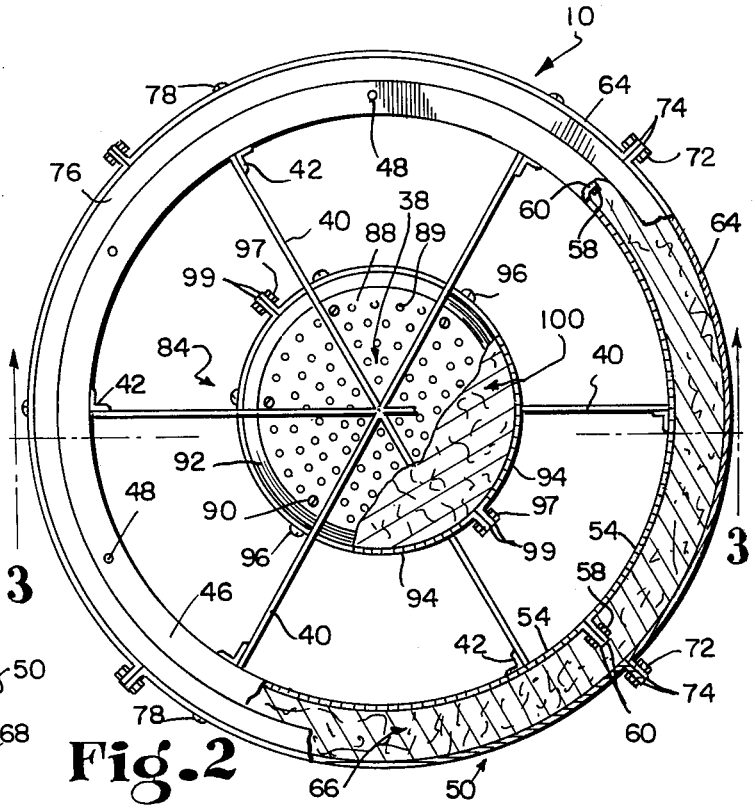
FIG. 2 is an enlarged end view of the silencer taken on the line 2—2 of FIG. 1, with portions thereof broken away.

The silencer 10 of this invention is shown in greater detail in FIGS. 2–4. As shown, the silencer comprises a frame having a spider-like assembly 38 at each end thereof. Each assembly 38 has a plurality of radially extending vanes 40 which are connected as by welding to one end of a longitudinally extending frame brace 42, such as a length of angle iron. Each brace 42 in turn has its opposite end similarly connected to one of the vanes 40 of the other spider assembly 38. Each frame brace 42 also has its ends connected as by welding to a pair of annular mounting rings 44. As shown best in FIG. 4, each of these mounting rings 44 has a right angle cross section to provide a face ring 46 having a plurality of holes 48 formed therethrough. Screws (not shown) are conveniently receivable through the holes 48 to mount the entire frame into a length of ductwork, such as the ductwork 12 shown in FIG. 1.

An external shell 50 for the silencer has an annular cross section and extends between the spider assemblies 38. The external shell 50 comprises an inner wall formed from a plurality of interconnected, arcuate inner wall sections 54 having perforations 52 therein. As shown, each inner wall section 54 is identical, and extends through an arc of about 90°. Each inner wall section is connected at each end to the mounting ring 44 of the frame by screws 56, and to adjacent ones of said wall sections by bolts 58 received through longitudinally and radially outwardly extending tabs 60. Importantly, for reasons which will hereafter become more apparent, said screws 56 and the bolts 58 are removable from the outwardly presented surfaces of said inner wall sections. Conveniently, if desired, a moisture-impervious plastic sheet 62 is wrapped about the outer surface of the inner wall and fixed in position by the screws 56, as shown in FIG. 4.

The external shell 50 of the silencer comprises an outer wall formed from interconnected wall sections 64 spaced radially outwardly from the inner wall to provide an annular chamber 66 for receiving a suitable insulating material 68, such as a high density fiberglas. The outer wall sections 64, like the inner wall sections 54, are interconnected to each other by bolts 72 received through longitudinally and radially outwardly extending tabs 74. Each outer wall section 64 is also fastened at each end to an angle ring 76 by screws 78. The angle ring 76 is in turn radially fixed with respect to the inner wall sections 54 by a spacer ring 80 connected as by welds 82 between said angle ring 76 and the mounting ring 44. Again, as with the inner wall sections, the screws 78 and the bolts 72 for the outer wall sections are removable from the outside of the silencer.

A cylindrical central core 84 for the silencer is mounted between the spider assemblies 38 to provide an air flow passage 86 of annular cross section between the central core 84 and the external shell 50. This central core 84 comprises a circular end plate 88 having perforations 89 therein and suitably mounted as by welding to each of the spider assemblies 38. Each end plate 88 is fastened by screws 90 to a corner ring 92, which is in turn connected to wall sections 94 of the central core by screws 96. Said wall sections 94 each have a semicircular cross section and are provided with perforations 95. Said sections 94 are connected to each other by bolts 97 received through longitudinally extending tabs 99. The interconnected core wall sections 94 thus provide a cylindrical chamber 100 for reception of a quantity of insulating material 102 to absorb noise generated by the exhaust fan. Importantly, as with the wall sections of the external shell 50, both the screws 96 and the bolts 97 for positioning the core wall sections 94 are removable from the outside of the core.

Exhaust air from the work station 16 is thus pulled by the fan 14 through the annular air passage 86 in the silencer. The silencer serves effectively to absorb noise generated by the fan by means of its perforated walls and insulating material. This reduces the noise volume at the work station to a safe level. However, when the silencer is used in a painting application as illustrated in FIG. 1, the air drawn through the fan silencer contains paint and water vapors and particles which tend to saturate the insulating material and clog the perforations in the silencer. This undesirably reduces the ability of the silencer to control the noise level at the work station.

In the silencer of this invention, the insulating materials 68 and 102 in the external shell 50 and the central core 84 are easily replaceable. When such replacement is desired, the outer wall sections 64 of the external shell are removable by removing the connecting screws 78 and the bolts 72. This is easily done without removing the silencer frame from the ductwork because the screws and bolts are accessible from the outside of the silencer. Then, the insulation 68 in the annular chamber 66 is removable for discarding. The inner wall sections 54 of the external shell 50 are then removable by removing the now-accessible connecting screws 56 and the bolts 58 to provide easy access to the silencer central core 84. Then, by removing the core screws 96 and bolts 97, the core wall sections 94 are easily removable for replacement of the insulation 102 contained therein. At this time, the perforated core wall sections 94 and the perforated inner wall sections 54 of the external shell can be cleaned in any convenient manner to assure that their perforations are unclogged.

The silencer is easily reassembled in the reverse order of its disassembly. The core wall sections 94 are re-installed with fresh insulation contained therein. Then, the inner wall sections 54 of the external shell are fastened into position with new insulation wrapped thereabout. Finally, the outer wall sections are re-positioned to allow the silencer to again be used to effectively absorb fan noise.

Figure 5:
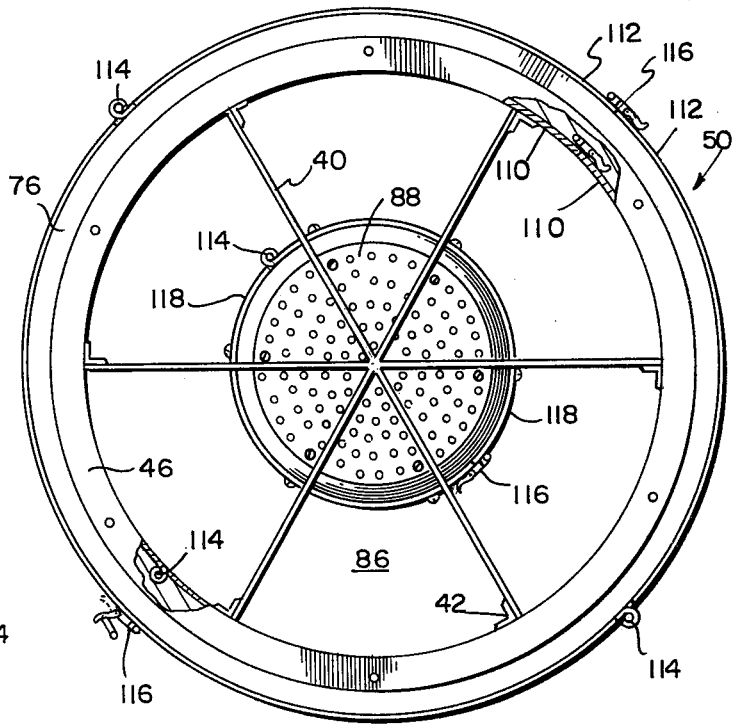
FIG. 5 is an end view, similar to FIG. 2, of an alternate embodiment of a fan silencer of this invention, with portions thereof broken away.

An alternate construction of a fan silencer of this invention is shown in FIG. 5. As shown, the external shell again comprises interconnected inner wall sections 110 and outer wall sections 112. However, each of the wall sections 110 and 112 is longitudinally hinged on one side to an adjacent wall section by a hinge 114. The other side of each of the wall sections 110 and 112 is releasably connected to another adjacent wall section by a conventional type suitcase latch assembly 116. Similarly, wall sections 118 of the central core 84 are interconnected on one side by a hinge 114 and on the other by one or more of the latch assemblies 116. Desirably, all of the wall sections are still fastened at each end thereof to the silencer frame by screws or the like to prevent the various wall sections from vibrating during operation of the fan.

With the silencer construction shown in FIG. 5, the outer wall sections 112 and the inner wall sections 110 are again quickly removable in succession to allow removal of the insulation in the external shell and to expose the central core 84. Then, the core wall sections 118 are quickly removable for cleaning and to permit replacement of the insulation contained therein. The various wall sections can then be re-positioned along with new insulation in reverse order of their disassembly to again place the silencer in an operative condition.

While screws, bolts, and suitcase latches have been described for use in making the various connections in the silencer of this invention, a wide variety of connecting devices can be used. For example, as shown in FIG. 6, a conventional one-quarter turn fastener 120 is used to fasten the outer wall sections 64 of the external shell 50 to the angle ring 76. Such a fastener comprises a spring-loaded shank 122 having a perpendicular pin 124 at the end thereof. The pin and shank are received through a slot 126 in the wall 64 and the ring 76. Then, by rotating the shank through 90°, the spring-loaded shank causes the pin to engage the ring 76 to secure the wall section and the angle ring together. Such one-quarter fastener is easily disconnected, and can be used for almost any of the silencer connections.

We claim:

1. A fan silencer comprising a frame for mounting said silencer into ductwork; a central core having a perforated core wall; first connecting means for releasably fixing said core wall with respect to said frame to form a central chamber for supporting insulating material; an external shell having a perforated inner wall and an outer wall; second connecting means for releasably fixing said inner wall with respect to said frame to form an air flow passage between said inner wall and said central core; and third connecting means for releasably fixing said outer wall with respect to said frame to form a shell chamber between said inner and outer walls for receiving insulating material.

2. A fan silencer as set forth in claim 1 wherein said perforated core wall comprises a plurality of core wall sections, and said first connecting means comprises means for releasably fixing said wall sections with respect to said frame and for releasably interconnecting said core wall sections to form said central core.

3. A fan silencer as set forth in claim 1 wherein said first connecting means is accessible from the outside of said central core.

4. A fan silencer as set forth in claim 1 wherein said perforated inner wall comprises a plurality of inner wall sections, and said second connecting means comprises means for releasably fixing said inner wall sections with respect to said frame and for releasably interconnecting said inner wall sections to form said inner wall of said external shell.

5. A fan silencer as set forth in claim 1 wherein said second connecting means is accessible from the outwardly presented surface of said inner wall.

6. A fan silencer as set forth in claim 1 wherein said outer wall comprises a plurality of outer wall sections, and said third connecting means comprises means for releasably fixing said outer wall sections with respect to said frame and for releasably interconnecting said outer wall sections to form said outer wall of said external shell.

7. A fan silencer as set forth in claim 1 wherein said third connecting means is accessible from the outwardly presented surface of the silencer.

8. The fan silencer as set forth in claim 1 wherein said third, second, and first connecting means are each respectively accessible from the outwardly presented surface of said outer, inner, and core walls, whereby said outer, inner, and core walls are removable in succession from said frame.

9. A fan silencer comprising a frame for mounting said silencer into ductwork; a central core mounted on said frame and having a plurality of perforated core wall sections; first connecting means for releasably interconnecting said core wall sections and for fixing the same with respect to said frame to form a central chamber for receiving insulating material; an external shell having a plurality of perforated inner wall sections and a plurality of outer wall sections; and second and third connecting means for releasably interconnecting respectively said inner and outer wall sections and for fixing the same with respect to said frame to form an air flow passage between said central core and external shell and to form an external shell chamber between said inner and outer wall sections for receiving insulating material.

10. A fan silencer as set forth in claim 9 wherein said third, second, and first connecting means are each respectively accessible from the outwardly presented surface of said outer, inner, and core wall sections, whereby said outer, inner, and core wall sections are removable in succession from said frame.

11. A fan silencer comprising a frame for mounting said silencer into ductwork; a central core mounted on said frame and having a plurality of perforated wall sections; first connecting means accessible from the outwardly presented surface of said central core for releasably fixing said core wall sections with respect to said frame to form a central chamber for receiving insulating material; an external shell having a plurality of perforated inner wall sections and a plurality of outer wall sections; second connecting means for releasably fixing said inner wall sections with respect to said frame to form an air flow passage between said external shell and said central core; and third connecting means accessible from the outwardly presented surface of the silencer for releasably fixing said outer wall sections with respect to the frame to form a shell chamber between said inner and outer wall sections for receiving insulating material.

* * * * *